US009072955B2

(12) United States Patent
King

(10) Patent No.: US 9,072,955 B2
(45) Date of Patent: Jul. 7, 2015

(54) ADJUSTABLE RESISTANCE KICKBOARD

(71) Applicant: Evan King, Barrie (CA)

(72) Inventor: Evan King, Barrie (CA)

( * ) Notice: Subject to any disclaimer, the term of this patent is extended or adjusted under 35 U.S.C. 154(b) by 0 days.

(21) Appl. No.: 14/140,154

(22) Filed: Dec. 24, 2013

(65) Prior Publication Data

US 2014/0179181 A1 Jun. 26, 2014

(51) Int. Cl.
*A63B 69/14* (2006.01)
*A63B 21/008* (2006.01)
*A63B 21/00* (2006.01)

(52) U.S. Cl.
CPC ..... *A63B 69/14* (2013.01); *A63B 21/0084* (2013.01); *A63B 21/00069* (2013.01)

(58) Field of Classification Search
CPC ..... A63B 69/14; A63B 21/0084; A63B 21/00069
USPC ..... 441/65, 74, 79
See application file for complete search history.

(56) References Cited

U.S. PATENT DOCUMENTS

| | | | | |
|---|---|---|---|---|
| 4,325,154 | A * | 4/1982 | Collum, Jr. | 441/74 |
| 4,781,638 | A | 11/1988 | Winters, Jr. | |
| 4,805,546 | A * | 2/1989 | Geller et al. | 114/132 |
| 4,865,271 | A * | 9/1989 | Savill | 244/130 |
| 5,493,989 | A * | 2/1996 | Anderson | 114/138 |
| 6,955,577 | B1 | 10/2005 | Hall | |
| 7,285,031 | B2 * | 10/2007 | Mair et al. | 441/79 |
| 7,597,601 | B2 | 10/2009 | Mravca | |

FOREIGN PATENT DOCUMENTS

FR 2421637 3/1978

* cited by examiner

*Primary Examiner* — Edwin Swinehart
(74) *Attorney, Agent, or Firm* — Oyen Wiggs Green & Mutala LLP

(57) ABSTRACT

A variable-resistance kickboard apparatus includes a buoyant kickboard body having an upper surface, a lower surface, and an opening extending through the kickboard body between the upper and lower surfaces. The apparatus also includes a blade extending through the opening and slidably engaged in the opening. The blade can be raised and lowered in the opening to adjust the proportion of the blade that extends below the lower surface.

19 Claims, 9 Drawing Sheets

FIG. 1 – Prior Art

ADJUSTABLE RESISTANCE KICKBOARD

CROSS-REFERENCE TO RELATED APPLICATIONS

This application claims priority from U.S. Application No. 61/848,076 filed 26 Dec. 2012 and entitled ADJUSTABLE RESISTANCE KICKBOARD. For purposes of the United States, this application claims the benefit under 35 U.S.C. §119 of U.S. Application No. 61/848,076 filed 26 Dec. 2012 and entitled ADJUSTABLE RESISTANCE KICKBOARD which is hereby incorporated herein by reference for all purposes.

TECHNICAL FIELD

This application relates to swimming. Embodiments are applicable to apparatus, kits, and methods for resistance training for swimmers.

BACKGROUND

Swimmers sometimes use various resistance apparatus to increase the resistance to their motion through the water. Swimming against a relatively higher level of resistance may be an effective training technique, and may increase the strength and endurance of a swimmer.

Existing resistance apparatus for swimmers include paddles, parachutes, rubber bands, and drag suits.

A swimmer may also use a standard kickboard to provide increased resistance. For example, a swimmer may hold a standard kickboard 10 (e.g. a kickboard of the general type illustrated in FIG. 1) so that at least a portion of the surface 11 of kickboard 10 is underwater and generally orthogonal to the direction of motion of the swimmer through the water.

A standard kickboard is buoyant in water, and thus a swimmer must exert downward force on kickboard 10 to keep at least a portion of it underwater. This may be difficult or distracting for a swimmer and it may put strain on a swimmer's arms and shoulders.

There remains a need for apparatus, kits, and methods for resistance training for swimmers.

SUMMARY

This invention has various aspects. One aspect of the invention provides a kickboard apparatus. The kickboard apparatus comprises a buoyant kickboard body comprising an upper surface, a lower surface, and an opening extending through the kickboard body between the upper and lower surfaces. The kickboard apparatus also comprises a blade extending through the opening and slidably engaged in the opening. The blade can be raised and lowered in the opening to adjust the proportion of the blade that extends below the lower surface.

In some embodiments the kickboard apparatus comprises a support structure. The support structure extends into the opening and serves to reinforce the kickboard body and/or facilitate holding the blade at a desired elevation and orientation.

In some embodiments a first side of the blade is biased against a first side of the support structure formed to hold the blade at a fixed angle to the kickboard body. The blade is frictionally held in the opening by the support structure.

In some embodiments at least a portion of the first side of the support structure is generally perpendicular to the lower surface of the kickboard body.

In some embodiments the blade is held frictionally with a force that is high enough to prevent the blade from moving up and down in the opening while the kickboard apparatus is being moved through the water by a swimmer and low enough to permit a swimmer to manually move the blade up and down in the opening to adjust the resistance provided by the kickboard apparatus.

In some embodiments the support structure comprises a deformation component configured to exert a restorative deformation force against the blade.

In some embodiments the blade comprises a plurality of longitudinally-spaced-apart indents and the blade is positionable within the opening so that the deformation component selectively extends into any one of the plurality of indents.

In some embodiments the support structure dads a portion of the upper surface adjacent to the opening and the support structure dads a portion of the lower surface adjacent to the opening.

In some embodiments the support structure comprises an upper component cladding the portion of the upper surface adjacent to the opening and a lower component cladding the portion of the lower surface adjacent to the opening. The upper component comprises an upper connector; the lower component comprises a lower connector; at least one of the upper and the lower connector extends into the opening; and the upper and lower connectors form a connection therebetween.

In some embodiments the connection is a snap-together connection.

In some embodiments the blade comprises a plurality of longitudinally-extending ribs.

In some embodiments the ribs are resiliently deformable.

In some embodiments the blade is removable from the opening.

In some embodiments a latitudinal cross-section of the blade has a concave shape.

Another aspect of the invention comprises a kit. The kit comprises a template showing the dimensions of an opening to be formed in a kickboard body and a blade dimensioned to be moveable up and down in an opening in a kickboard body, the opening having the dimensions shown in the template.

In some embodiments the kit comprises a support structure defining a channel therethrough, wherein the blade is dimensioned to be moveable up and down in the channel and to be frictionally held by the support structure within the channel.

In some embodiments the support structure comprises a support structure upper component comprising an upper connector and a support structure lower component comprising a lower connector. The upper and lower connectors are connectable to form a connection that extends through an opening, the opening having the dimensions shown in the template.

Another aspect of the invention provides a method for adjusting the resistance level of a kickboard apparatus. The method comprises providing a buoyant kickboard body comprising an upper surface, a lower surface, an opening extending through the upper and lower surfaces, and a blade extending through the opening. A portion of the blade extends below the lower surface of the kickboard body defining a resistance surface. The method further comprises sliding the blade up or down through the opening to increase or decrease an area of the resistance surface.

In some embodiments the method comprises completely removing the blade from the opening.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 2:
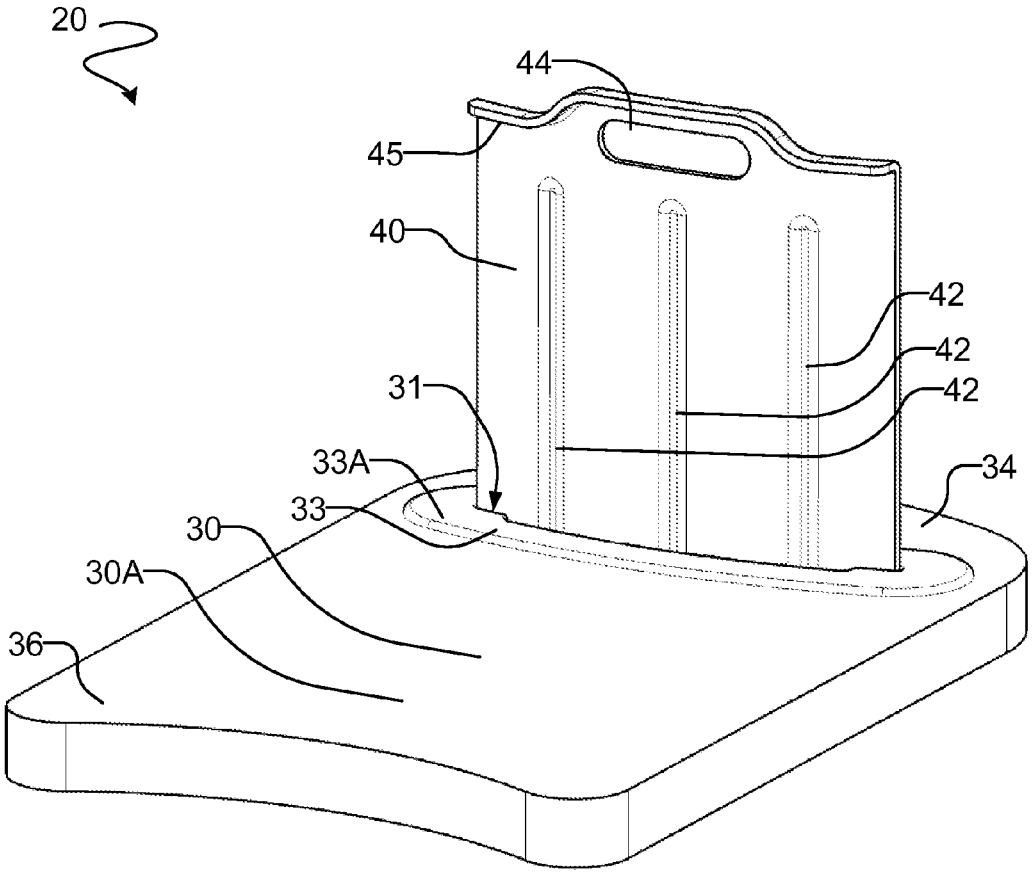
FIG. 2 is an isometric view of an adjustable-resistance kickboard in a "raised blade" configuration, according to an example embodiment.

FIG. 2 is an isometric view of an adjustable-resistance kickboard 20 according to an example embodiment. Adjustable-resistance kickboard 20 comprises a kickboard body 30 and a blade 40. In FIG. 2, blade 40 is in a "raised blade" configuration.

Figure 1:
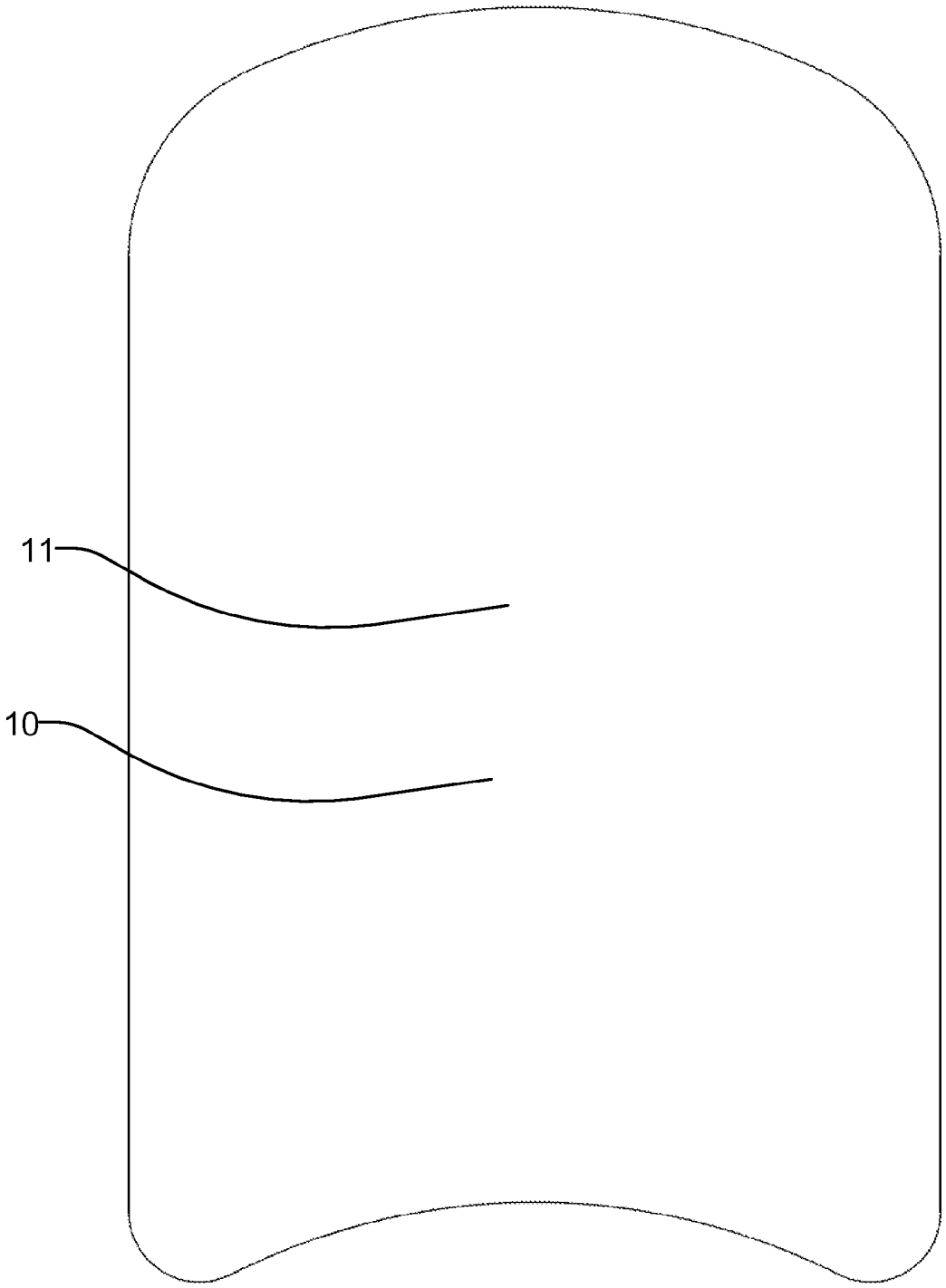
FIG. 1 is a top plan view of a prior art kickboard.

Kickboard body 30 comprises an opening 31. Blade 40 can be slidably engaged in opening 31 to provide different levels of resistance. Kickboard body 30 may comprise a standard kickboard through which an opening 31 has been cut. For example, kickboard body 30 may comprise a sheet of a closed-cell foam material which may be shaped, for example, as a kickboard as shown in FIG. 1. Kickboard body 30 is typically rigid enough to maintain a generally planar configuration in use. In some embodiments, kickboard body 30 is custom made for purpose and opening 31 is formed during manufacturing.

Kickboard body 30 may be made of any suitable material. In some embodiments, kickboard body 30 is made of material that floats on water (i.e. is buoyant). In some embodiments, kickboard body 30 is made of material that is not degraded by chlorinated water. In some embodiments kickboard body 30 comprises ethylene-vinyl acetate foam, energy absorbing foam, or the like. In some embodiments kickboard body 30 comprises a standard kickboard (e.g. a kickboard of the general type illustrated in FIG. 1).

Kickboard body 30 comprises an upper surface 30A and a lower surface 30B. Opening 31 extends through kickboard body 30 and through upper and lower surfaces 30A and 30B. An inside surface 30C (best seen in FIG. 4) of kickboard body 30 defines a wall of opening 31. Opening 31 is dimensioned to accommodate the insertion of blade 40 therethrough. In some embodiments kickboard body 30 is formed with opening 31. In some embodiments opening 31 is cut or stamped out of kickboard body 30.

In some embodiments, kickboard body 30 is up to about one meter in length, and more typically is approximately 30-60 cm in length. In some embodiments, kickboard body 30 is up to about 10 cm in thickness, and more typically is approximately 2-5 cm in thickness. In some embodiments, kickboard body 30 is up to about 60 cm in width, and more typically is approximately 20-50 cm in width. In some embodiments, kickboard body 30 is up to about one kilogram in weight, and more typically is approximately 300-600 g in weight. Kickboard body 30 is typically somewhat longer than it is wide.

Kickboard body 30 is optionally provided with a support structure. The support structure may accomplish one or both of the following functions: (1) reinforce kickboard body 30, especially in the area around opening 31, and (2) help support blade 40 in opening 31. The support structure may extend around opening 31 on surfaces 30A, 30B, and 30C.

In the illustrated embodiment, a support structure 33 dads inside surface 30C and portions of upper surface 30A and lower surface 30B adjacent to opening 31. Support structure 33 may be made of any suitable material (e.g. plastic). Support structure 33 may comprise a material that is relatively stronger and/or stiffer than the material of kickboard body 30.

In some embodiments, support structure 33 dads only a portion of inside surface 30C, upper surface 30A, and/or lower surface 30B. In some embodiments, support structure 33 does not clad anything, for example, support structure 33 may comprise a skeletal "frame" that extends across portions of inside surface 30C, upper surface 30A, and/or lower surface 30B.

Figure 4:
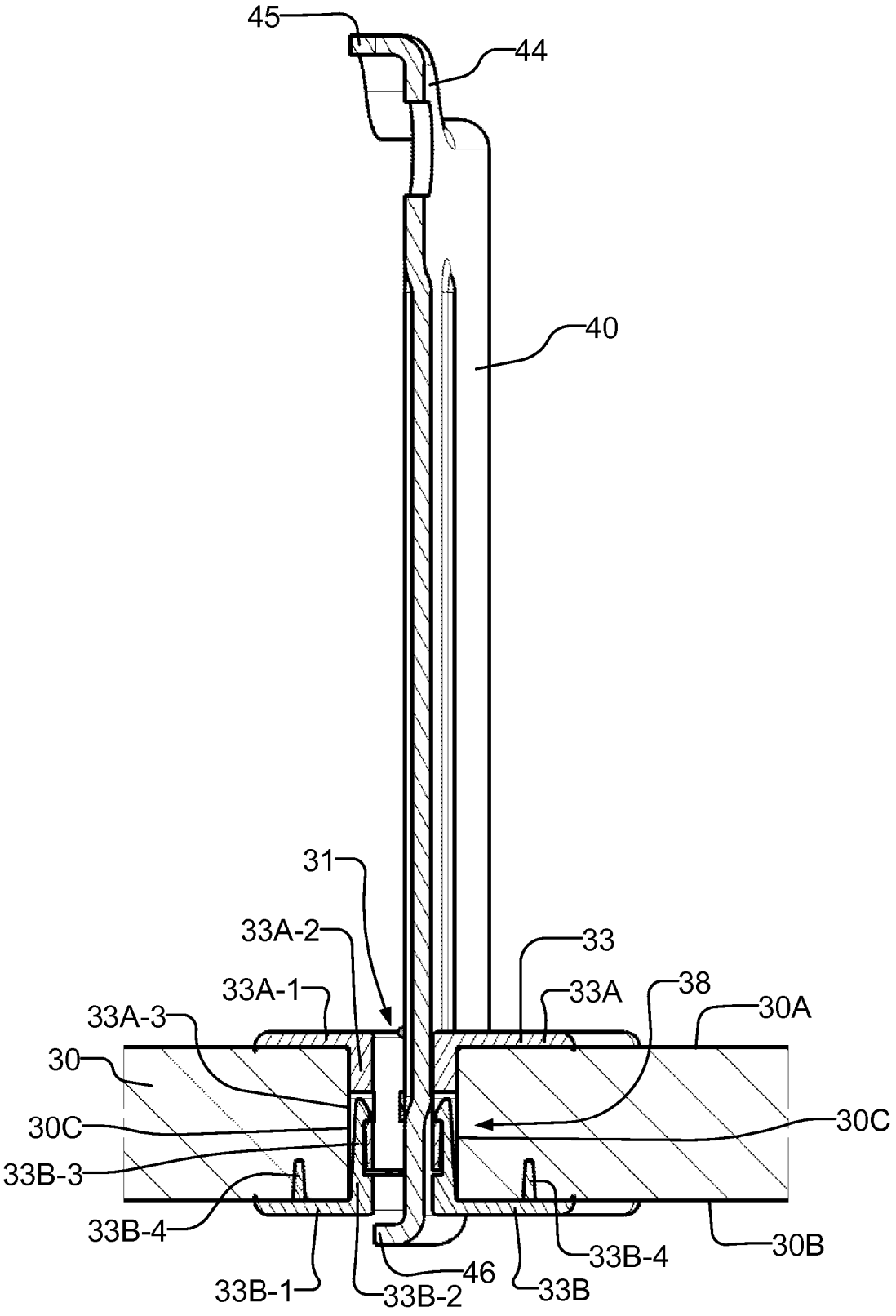
FIG. 4 is a cross-sectional view through line A-A (as shown in FIG. 3) of the adjustable-resistance kickboard of FIG. 2.

As best seen in FIG. 4, support structure 33 may comprise an upper component 33A and a lower component 33B.

Upper component 33A may comprise a first member 33A-1 that dads a portion of upper surface 30A adjacent to opening 31 and a second member 33A-2 that dads a portion of inside surface 30C.

Lower component 33B may comprise a first member 33B-1 that dads a portion of lower surface 30B adjacent to opening 31 and a second member 33B-2 that dads a portion of inside surface 30C.

Second members 33A-2 and 33B-2 may together clad the entirety of inside surface 30C.

Second member 33A-2 may comprise a connector 33A-3. Second member 33B-2 may comprise a connector 33B-3. Connectors 33A-3 and 33B-3 may be connectable to form a connection 38.

Connection 38 may comprise any suitable type of connection. For example, connection 38 may be a "snap-together" connection that is formed by deforming one or both of connectors 33A-3 and 33B-3 until they "snap" into a locked configuration. Connectors 33A-3 and 33B-3 may comprise corresponding hooks and concavities that engage each other. Connection 38 may hold support structure 33 in place around opening 31.

In some embodiments second members 33A-2 and 33B-2 do not have connectors, and are connected to one another by other means (e.g. adhesives, fasteners, etc.). In some embodiments second members 33A-2 and 33B-2 are integrally formed with each other. In some embodiments upper and lower components 33A and 33B are directly connected to kickboard body (e.g. by adhesive, fasteners, etc.).

In the embodiment illustrated in FIG. 4, lower component 31B has pins 33B-4 that extend into kickboard body 30. Pins 33B-4 may prevent relative movement of support structure 33 and kickboard body 30 and may increase the overall strength and rigidly of adjustable-resistance kickboard 20. In some embodiments, upper component 33A may also have pins (not shown) that project into the material of kickboard body 30.

Kickboard body 30 has a front end 34 and a back end 36 (see FIG. 2). In the illustrated embodiment, opening 31 is located closer to front end 34 than back end 36. In other embodiments, opening 31 may be located elsewhere on kickboard body 30 (e.g. closer to back end 36 than front end 34, or in the middle of kickboard body 30). When opening 31 is located near front end 34, a swimmer may rest his or her arms on back end 36 of kickboard body 30 while swimming.

In some embodiments, one or both of front end 34 and back end 36 are curved (for example, as shown in FIG. 1), straight, or otherwise shaped. For example, front end 34 may comprise a generally triangular shape with a pointed or rounded tip. In some embodiments, one or both of front end 34 and back end 36 are symmetrical around a centerline of kickboard body 30. Here, the "centerline" is a notional line that runs from the center of front end 34 to the center of back end 36.

In some embodiments opening 31 and blade 40 extend across 50%, 60%, 70%, 80%, or 90% of the width of kickboard body 30.

Figure 3:
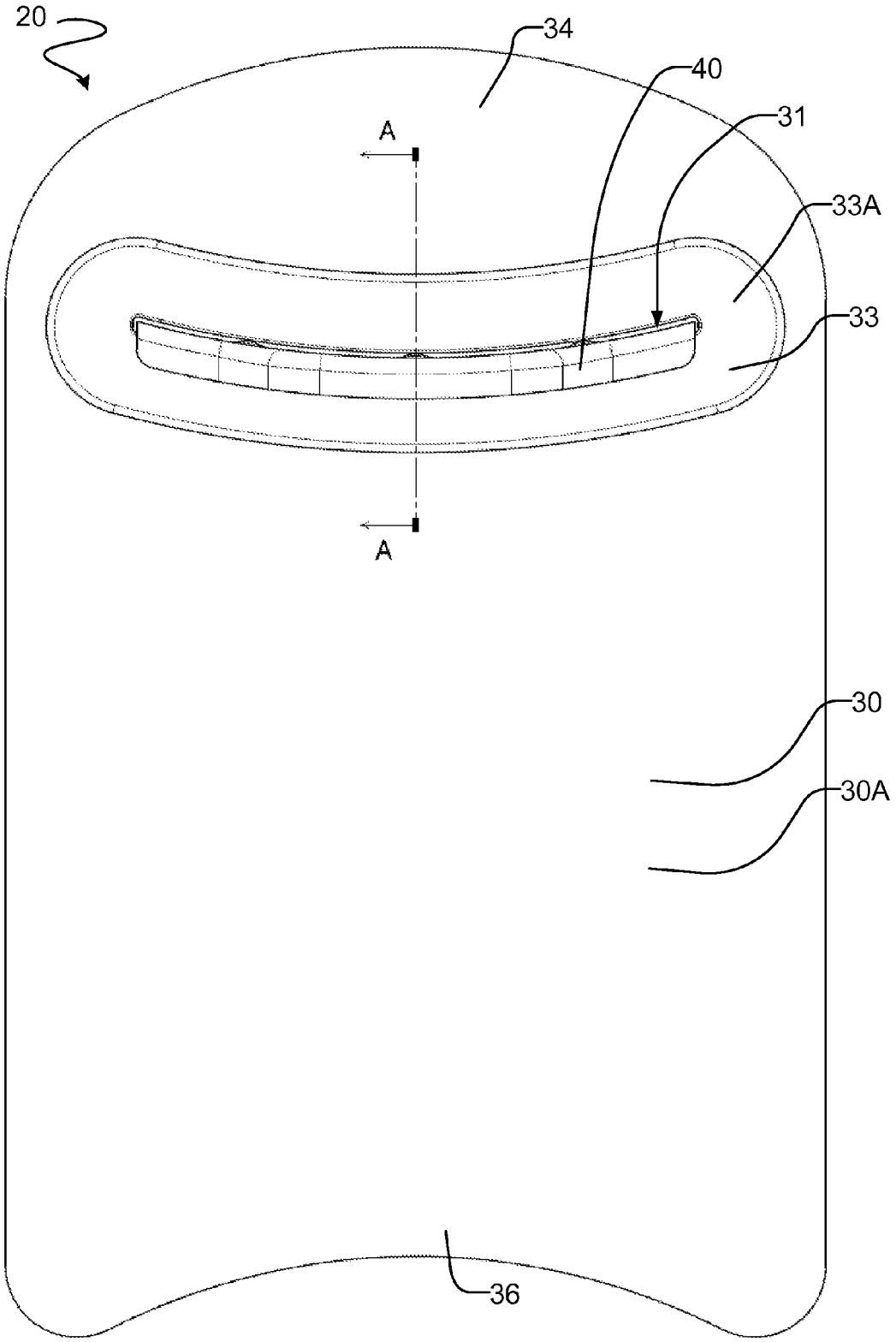
FIG. 3 is a top plan view of the adjustable-resistance kickboard of FIG. 2.

As best seen in FIG. 3, opening 31 and blade 40 may be shaped to define a concavity that opens toward front end 34 of kickboard body 30 (i.e. opening 31 and blade 40 may have a "concave forward" shape). In some alternative embodiments, opening 31 and blade 40 are shaped to define a concavity that opens toward back end 36 of kickboard body 30 (i.e. opening 31 and blade 40 may have a "concave backward" shape). The "concave forward" shape may be relatively less streamlined than the "concave backward" shape, and may consequently provide relatively more resistance as a swimmer moves variable-resistance kickboard 20 through the water. Both the "concave forward" and the "concave backward" shapes of blade 40 may strengthen blade 40 and support it against bending as it moves through the water.

Opening 31 may be disposed towards the front end 34, back end 36, or mid-point (i.e. mid-way between front end 34 and back end 36) of kickboard body 30. In some embodiments, opening 31 is disposed away from the mid-point of kickboard body 30 to provide additional rigidity around the mid-point of kickboard body 30. In some embodiments, opening 31 is disposed towards front end 34 of kickboard body 30 in order to position blade 40 further from the user.

Opening 31 may, in some embodiments, be symmetrical around a centerline of kickboard body 30 (as shown, for example, in FIG. 3). Opening 31 may run substantially transverse to the centerline (as shown, for example, in FIG. 3). Opening 31 may be straight, curved (as shown, for example, in FIG. 3), and/or otherwise shaped. In some embodiments, opening 31 is curved and has a radius of curvature in a range from 10 cm to 50 cm. Opening 31 may be irregularly shaped; for example, opening 31 may comprise circular openings joined with straight or curved openings. Opening 31 may extend across a longitudinal portion of kickboard body 30 that is longer than a width of opening 31. For example, a curved opening 31 with a width of 2 cm may extend from a point 8 cm away from front end 34 to a point 12 cm away from front end 34, due to the curvature of the example opening 31.

Blade 40 is shaped to be received by opening 31. In some embodiments, blade 40 and opening 31 have similar cross-sections (e.g., opening 31 and blade 40 may both be curved and have the same or similar radii of curvature). In other embodiments, the cross-sections of blade 40 and opening 31 are dissimilar (e.g. opening 31 may be curved and blade 40 may be straight).

Figure 5A:
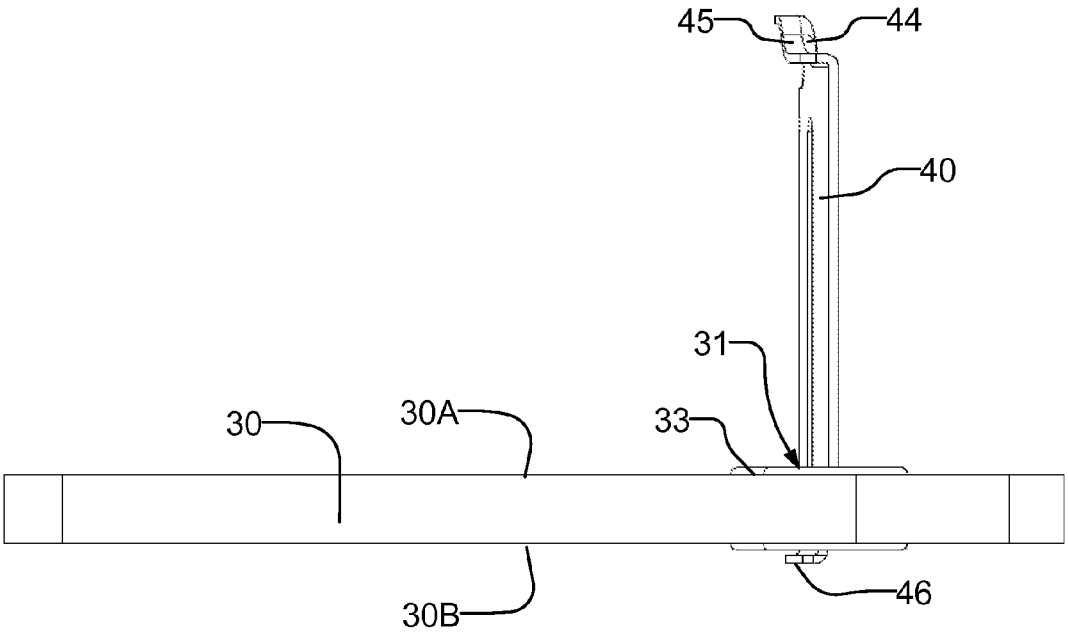
FIG. 5A is a side elevation view of the adjustable-resistance kickboard of FIG. 2 in a "raised blade" configuration.
Figure 5B:
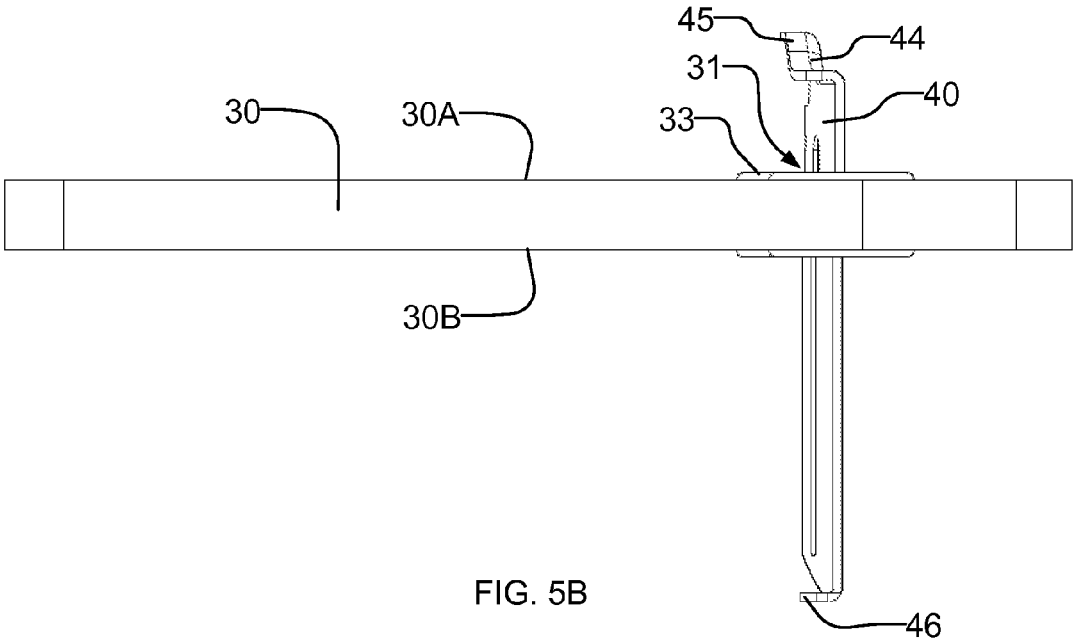
FIG. 5B is a side elevation view of the adjustable-resistance kickboard of FIG. 2 in a "lowered blade" configuration.

Blade 40 may be moved up and down in opening 31, thereby changing the proportion of blade 40 that is in the water. Positioning a relatively larger proportion of blade 40 in the water may cause adjustable-resistance kickboard 20 to provide a relatively higher level of resistance. FIG. 5A is a side elevation view of adjustable-resistance kickboard 20 in a "raised blade" configuration that provides a relatively low level of resistance. FIG. 5B is a side elevation view of adjustable-resistance kickboard 20 in a "lowered blade" configuration that provides a relatively high level of resistance. Configurations between the "raised blade" and "lowered blade" configurations may provide intermediate levels of resistance. In some embodiments blade 40 is removable to further decrease resistance.

In some embodiments, blade 40 has a length of approximately 50-100% the length of kickboard body 30. In some embodiments, kickboard body 30 has a thickness substantially similar to the thickness of kickboard body 30. In some embodiments, blade 40 is movable so as to project a distance of up to 90% of its length from lower surface 30B, and more typically up to approximately 75% of its length from lower surface 30B. In some embodiments, the resistive area of blade 40 (i.e. the area of blade 40 projecting from lower surface 30B and facing against the direction of the flow of water, typically the forward direction) is in a range from 0.025 to 0.25 $m^2$.

In FIGS. 5A and 5B it can be seen that blade 40 and kickboard body 30 form a right angle. In these embodiments, blade 40 is slideably movable in a direction that is at least generally at right angles to kickboard body 30. In some embodiments blade 40 extends at an angle of 90°±5° to kickboard body 30. In other embodiments blade 40 and kickboard body 30 form other angles. For example, blade 40 and kickboard body 30 may form a 30, 60, 75, 105, 120, or 150 degree angle.

Support structure 33 may be configured to support blade 40 at a particular angle. For example (as seen in FIG. 4), support structure 33 may have opposed parallel walls that form a right angle to kickboard body 30 and support blade 40 at a right angle to kickboard body 30. Support structure 33 and blade 40 may be adjusted so that blade 40 is held at a desired angle to kickboard body 30 and motion of blade 40 is constrained to sliding up or down through the opening.

Blade 40 may be made of any suitable material (e.g. plastic). In some embodiments, blade 40 is made of a transparent material so a swimmer can see through blade 40. In some embodiments, blade 40 is generally rectangular. In some embodiments, blade 40 may have other shapes. For example, the bottom edge of blade 40 may form a "V" shape or a "U" shape.

In some embodiments blade 40 has markings printed thereon to indicate different "resistance settings". For example, blade 40 may have a plurality of latitudinally extending and longitudinally-spaced-apart lines printed or otherwise marked thereon. The lines may be sequentially numbered. Aligning "line #1" with upper surface 30A of kickboard body 30 may correspond to a first resistance setting. Aligning "line #2" with the upper surface of 30A of kickboard body 30 may correspond to a second resistance setting. Additional lines may be provided corresponding to additional resistance settings.

The materials and dimensions of blade 40 may be selected so that when blade 40 is fully lowered and a large proportion of blade 40 is in the water, kickboard body 30 still lies generally flat on surface of the water (e.g. lower surface 30B of kickboard body 30 lies completely under the surface of the water). This feature may permit a swimmer to use adjustable-resistance kickboard 20 without having to exert downward force on kickboard body 30 to keep blade 40 underwater, thereby permitting the swimmer to use adjustable-resistance kickboard 20 while maintaining a natural and comfortable body posture. In some embodiments the density of blade 40 is approximately the same as or greater than the density of water.

Support structure 33 and/or blade 40 may be configured so that the proportion of blade 40 below lower surface 30B of kickboard body 30 and, correspondingly, the resistance level provided by adjustable-resistance kickboard 20, stays constant during normal use, but can be adjusted as desired by a swimmer by raising and lowering blade 40 in opening 31. This feature may be implemented in many different ways, a few of which are described below.

In some embodiments blade 40 and support structure 33 are shaped and/or dimensioned so that blade 40 and/or support structure 33 must deform to accommodate the insertion of blade 40 into opening 31. In some embodiments blade 40 (or at least portions thereof) is wider than opening 31 and blade 40 and/or support structure 33 deforms to accommodate the insertion of blade 40 into opening 31. In some embodiments the curvatures of blade 40 and opening 31 are different (e.g. the radius of curvature of blade 40 may be larger or smaller than the radius of curvature of opening 31) and blade 40 and/or support structure 33 deforms to accommodate the insertion of blade 40 into opening 31. In some embodiments the portion of kickboard body 30 surrounding opening 31 may deform to accommodate the insertion of blade 40 into opening.

Blade 40 and/or support structure 33 may comprise resiliently deformable materials, and may exert restorative deformation forces against each other when blade 40 is inserted into opening 31. These restorative deformation forces may provide friction between blade 40 and support structure 33. This friction may resist up and down movement of blade 40 through opening 31. The materials and relative shapes/dimensions of blade 40 and support structure 33 may be selected to provide an appropriate level of friction. In some embodiments, the level of friction is high enough to prevent blade 40 moving within opening 31 while a swimmer is swimming, but low enough to permit a swimmer to manually move blade 40 up and down in opening 31 to adjust the resistance level.

Blade 40 may have one or more ribs 42 (best seen in FIG. 2) that project out of one or both sides of blade 40 and extend longitudinally along blade 40. Ribs 42 may provide contact surfaces that contact support structure 33. Support structure 33 may comprise channels (not shown) to receive ribs 42. Ribs 42 are optionally deformable, and may deform to accommodate the insertion of blade 40 into opening 31. Ribs 42 may strengthen blade 40 and support it against bending as it moves through the water.

In an alternative embodiment, support structure 33 comprises one or more deformation components. The deformation components may extend from support structure 33 into opening 31. The deformation components may deform to accommodate the insertion of blade 40 into opening 31. The deformation components may exert restorative deformation forces against blade 40, providing friction that resists up and down movement of blade 40 in opening 31.

Figure 6:
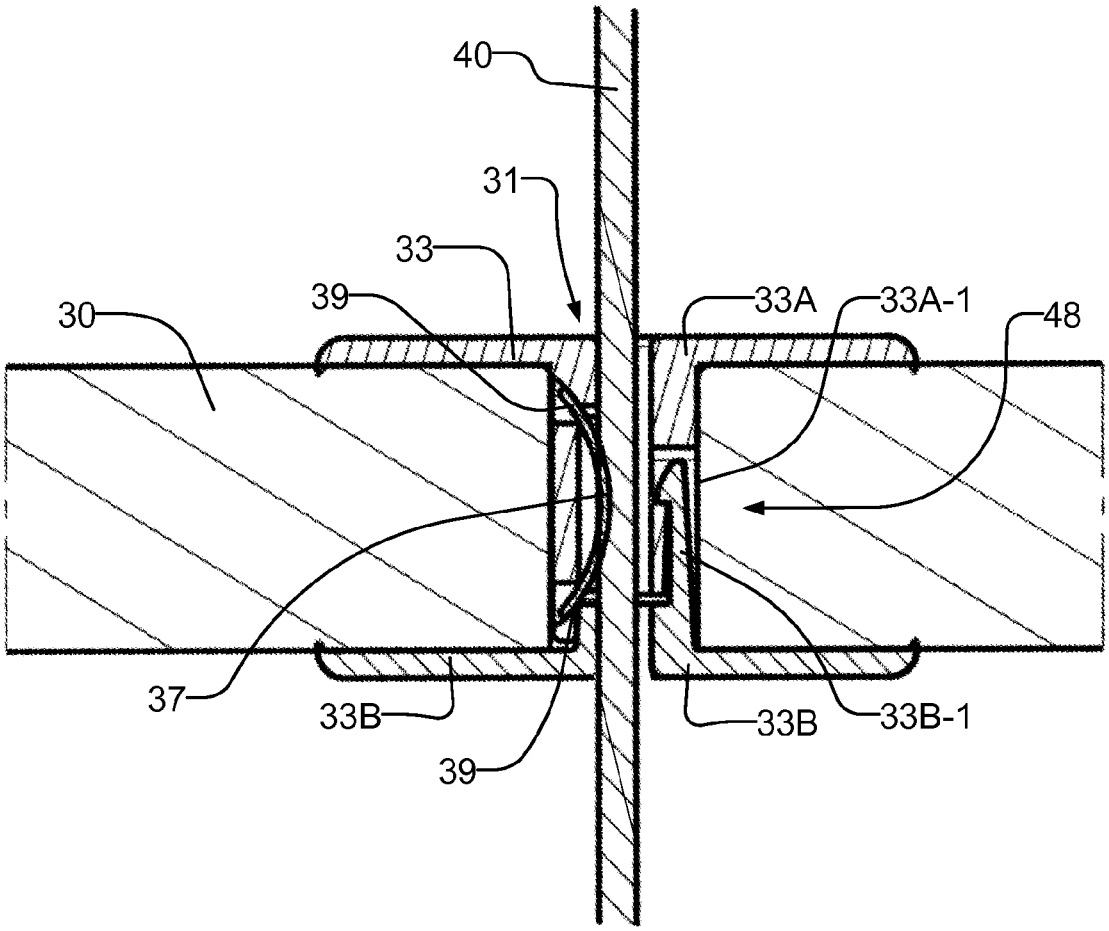
FIG. 6 is a cross-sectional view of a portion of an adjustable-resistance kickboard according to an alternative embodiment.

In an example embodiment illustrated in FIG. 6, a deformation component 37 comprises a curved member connected at opposed edges to support structure 33. In the illustrated embodiment, the opposed edges of deformation component 37 are received by slots 39 in support structure 33.

Deformation component 37 deforms to accommodate the insertion of blade 40 into opening 31. In other embodiments, deformation component 37 may have other designs (e.g. a coil spring, a coil spring and ball bearing mechanism, etc.). Deformation component 37 may be made of any suitable material (e.g. plastic, metal, etc.).

In an alternative embodiment, support structure 33 comprises a "detent mechanism" that allows blade 40 to be placed into any one of a plurality of different "resistance settings", each resistance setting corresponding to a different proportion of blade 40 extending below lower surface 30B of kickboard body 30. When blade 40 is in a particular resistance setting, the detent mechanism may hold blade 40 at a particular height and may exert a force against blade 40 that makes it relatively difficult to adjust the height of blade 40. The detent mechanism may, for example, comprise one or more members resiliently biased against a surface of blade 40 that is formed with indentations or apertures into which the resiliently biased members can project at selected positions of blade 40. Motion of blade 40 in opening 31 may encounter sharply increased resistance at some or all of the resistance settings and comparatively low resistance between resistance settings.

Many different types of detent mechanism are possible. In some embodiments, blade 40 may comprise a plurality of longitudinally-spaced-apart indents. Blade 40 may be pushed into opening 31 until a first indent aligns with a deformation component so the deformation component extends into the first indent. This state may correspond to a first "resistance setting". Moving blade 40 out of this first "resistance setting" may require a relatively strong force in order to disengage the deformation component from the first indent. Blade 40 may be pushed further until the deformation component aligns with a second indent. This position may correspond to a second "resistance setting". Any number of resistance settings may be similarly provided.

In some embodiments the longitudinally-spaced-apart indents extend latitudinally across blade 40. Some embodiments comprise a plurality of deformation components.

Figure 7A:
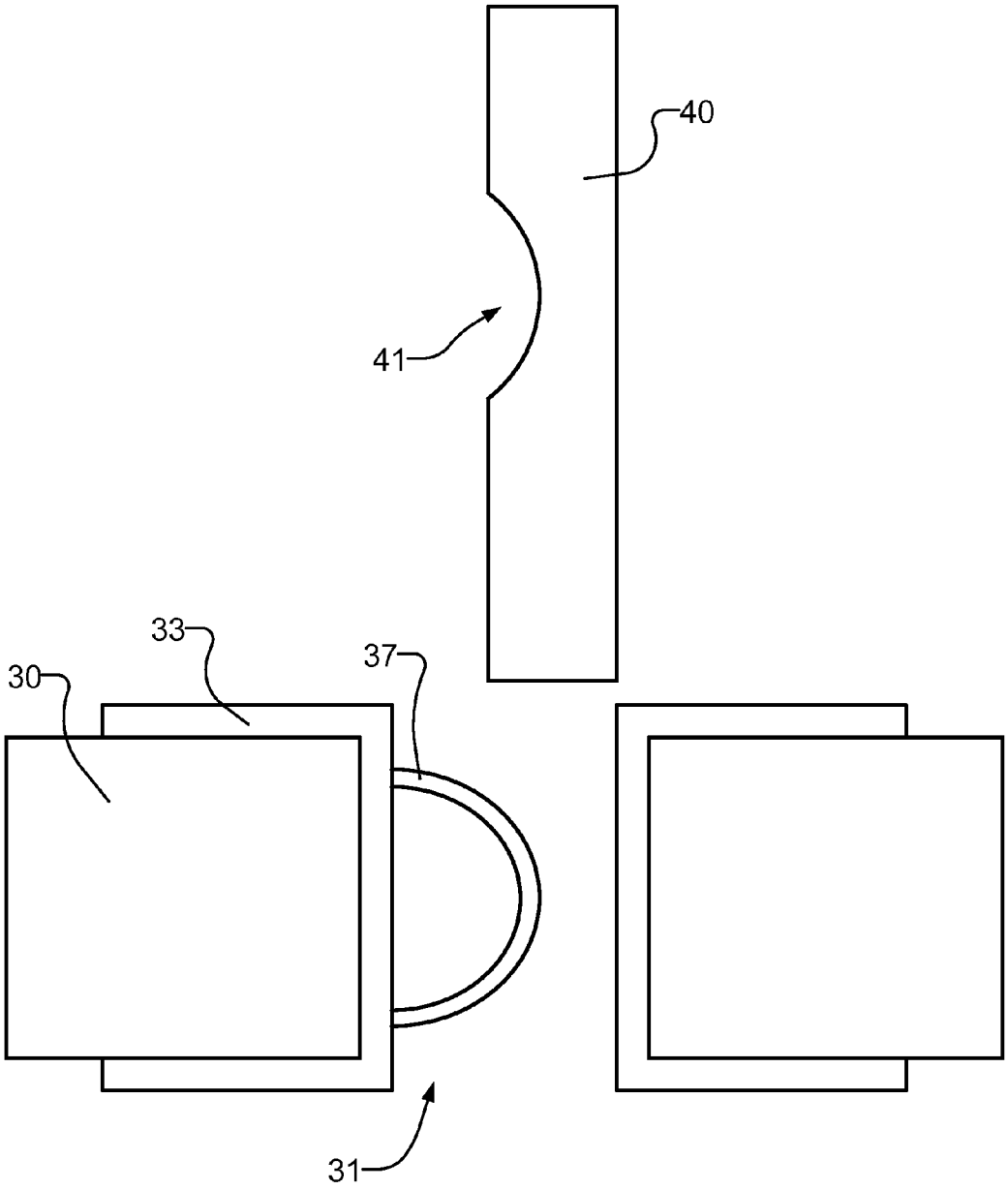
FIGS. 7A-C are cross-sectional views of a portion of an adjustable-resistance kickboard according to an alternative embodiment.
Figure 7B:
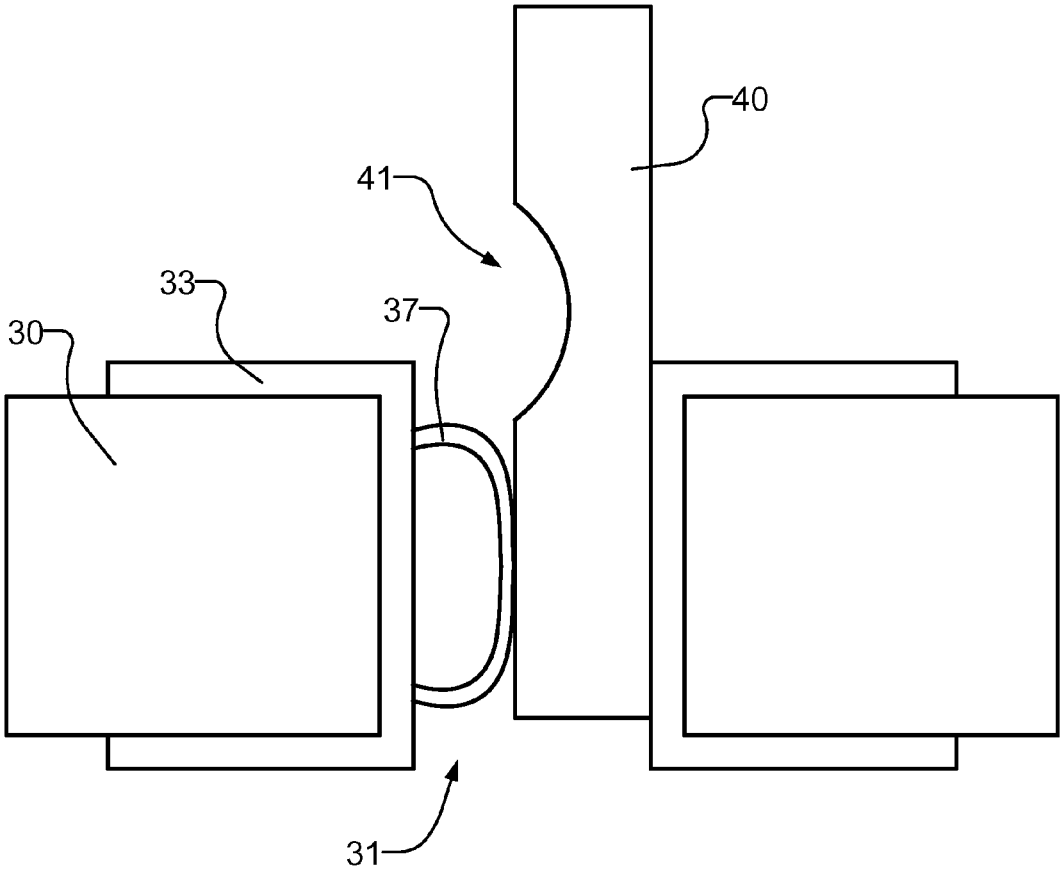
Figure 7C:
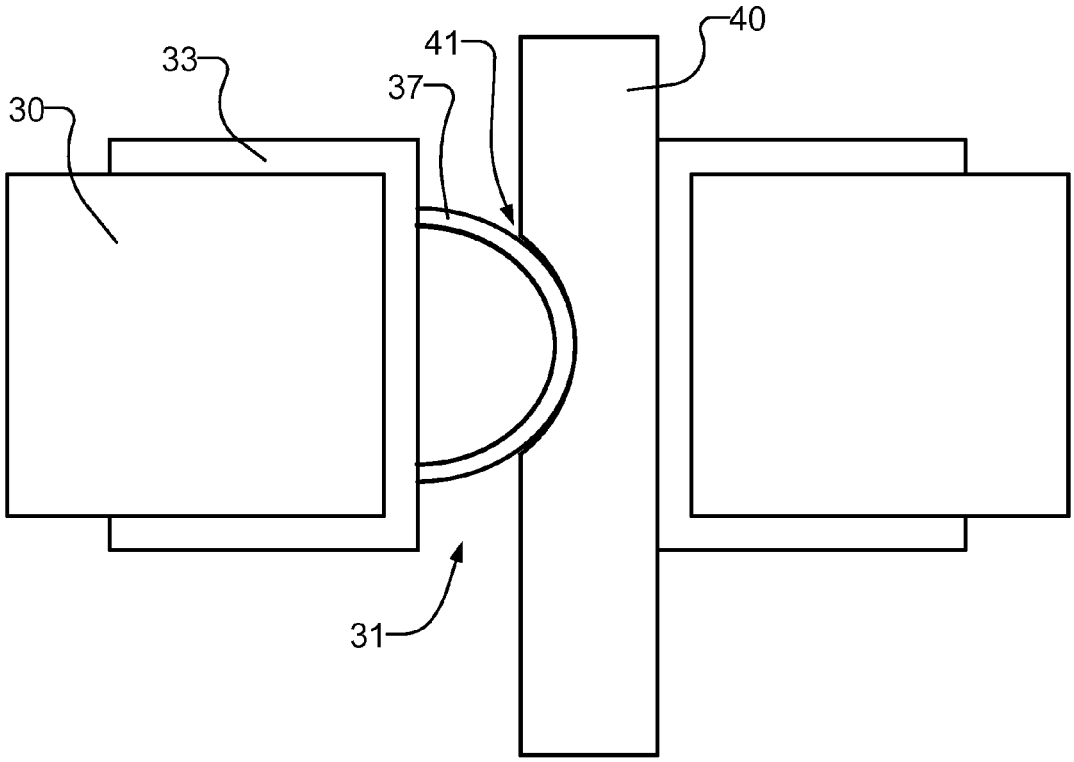

An example "detent mechanism" is illustrated in FIGS. 7A-C. FIGS. 7A-C are cross-sectional views of showing some of the steps involved in moving blade 40 into a particular resistance setting, according to an example embodiment. Blade 40 comprises an indent 41. In FIG. 7A, blade 40 is positioned above opening 31. In FIG. 7B, blade 40 is inserted into opening 31, thereby deforming deformation component 37. In FIG. 7C, blade 40 is further inserted into opening 31 until detent 41 aligns with deformation component 37 and deformation component 37 becomes relatively less deformed and extends into indent 41. In FIG. 7C, blade 40 is in a particular "resistance setting". Moving blade 40 out of this resistance setting requires applying a force to blade 40 that is sufficient to disengage deformation component 37 from indent 41. Blade 40 may have a plurality of longitudinally-spaced-apart indents 41 corresponding to a plurality of resistance settings. In some embodiments indent 41 may be replaced by an aperture through blade 40.

In some embodiments, a locking mechanism (not shown) may be provided to lock blade 40 at a particular height. The locking mechanism may comprise a screw, clamp, pin, or the like. A swimmer may move blade 40 to a desired height and then engage the locking mechanism to lock blade 40 at that desired height. When the swimmer decides to change the height of blade 40, he or she may disengage the locking mechanism, move the blade to a new desired height, then re-engage the locking mechanism.

Blade 40 may have a handle 44. Handle 44 may be used by a swimmer to adjust the position of blade 40 in opening 31 (e.g. by pulling or pushing on handle 44).

Blade 40 may have an upper lip 45 on its upper edge (best seen in FIG. 4) and a lower lip 46 on its lower edge (best seen in FIG. 4). Upper lip 45 may be shaped to prevent blade 40 from being pushed all the way through opening 31. Lower lip 46 may be shaped to prevent blade 40 from being pulled all the way through opening 31. In some embodiments, lower lip 46 may be shaped to make pulling blade 40 through opening 31 difficult, but not impossible. In some embodiments one or both of upper and lower lips 45 and 46 may be absent.

In some embodiments it is possible to completely remove blade 40 from opening 31. This feature is advantageous because it allows adjustable-resistance kickboard 20 to be reduced to a compact volume and conveniently stored or transported. This feature is also advantageous because it allows a swimmer to use kickboard body 30 alone as a standard kickboard.

A swimmer may use adjustable-resistance kickboard 20 by positioning blade 40 to provide a desired level of resistance and then swimming while holding adjustable-resistance kickboard 20. A swimmer may hold adjustable-resistance kickboard 20 with his or her hands while kicking with his or her feet. A swimmer may hold adjustable-resistance kickboard 20 in many different ways. A swimmer may hold the sides of kickboard body 30 near front end 34 or back end 36. A swimmer may hold front end 34 and rest his or her arms on upper surface 30A of kickboard body 30; this may allow a swimmer to bear some of his or her weight on kickboard body 30 and thereby swim with his or her head out of the water. If a swimmer decides to increase or decrease the resistance level, he or she may do so by adjusting the height of blade 40.

One embodiment of the invention comprises a kit for making an adjustable-resistance kickboard. The kit may comprise a buoyant kickboard body comprising an opening therethrough, and a blade dimensioned to be movable up and down within the opening. Alternatively, the kit may comprise a buoyant kickboard body that does not have an opening therethrough, and the kit may comprise a template showing where to cut an opening through the kickboard body. In the further alternative, the kit may comprise a template showing the dimensions of an opening to be cut through a kickboard body and a blade dimensioned to fit through an opening in a kickboard body with the dimensions shown by the template. This swimmer may use this kit to convert a standard kickboard into an adjustable-resistance kickboard. In such embodiments, the kickboard body and blade may provide with any of the features described above.

The kit may further comprise a support structure. The support structure may comprise an upper component and a lower component. Support structure, upper component, and lower component may have any of the features described above.

In some embodiments there is no support structure 33. In these embodiments, the portion of kickboard body 30 adjacent to opening 31 may have some or all of the same features of support structure 33 as described herein.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A kickboard apparatus comprising:

a buoyant kickboard body comprising an upper surface, a lower surface, and an opening extending through the kickboard body between the upper and lower surfaces;

a blade extending through the opening and slidably engaged in the opening, wherein, the blade can be raised and lowered in the opening to adjust a proportion of the blade that extends below the lower surface; and a support structure, the support structure extending into the opening, wherein, the support structure comprises a deformation component configured to push the blade against a surface of the support structure;

wherein the blade comprises a plurality of longitudinally-spaced-apart indents, and wherein the blade is positionable within the opening so that the deformation component extends into any one of the plurality of indents.

2. The kickboard apparatus according to claim 1 wherein a first side of the blade is biased against a first side of the support structure formed to hold the blade at a fixed angle to the kickboard body.

3. The kickboard apparatus according to claim 2 wherein the blade is frictionally held in the opening by the support structure.

4. The kickboard apparatus according to claim 3 wherein at least a portion of the first side of the support structure is generally perpendicular to the lower surface of the kickboard body.

5. The kickboard apparatus according to claim 1 wherein the blade is generally perpendicular to a longitudinal centerline of the kickboard body.

6. The kickboard apparatus according to claim 4 wherein the blade is held frictionally with a force that is:

high enough to prevent the blade from moving up and down in the opening while the kickboard apparatus is being moved through the water by a swimmer; and low enough to permit a swimmer to manually move the blade up and down in the opening.

7. The kickboard apparatus according to claim 1 wherein the blade is removable from the opening.

8. The kickboard apparatus according to claim 1 wherein a latitudinal cross-section of the blade has a concave shape.

9. A kickboard apparatus comprising:

a buoyant kickboard body comprising an upper surface, a lower surface, and an opening extending through the kickboard body between the upper and lower surfaces;

a blade extending through the opening and slidably engaged in the opening;

wherein the blade can be raised and lowered in the opening to adjust a proportion of the blade that extends below the lower surface; and a support structure, the support structure extending into the opening;

wherein the support structure clads a portion of the upper surface adjacent to the opening and the support structure clads a portion of the lower surface adjacent to the opening; and the support structure comprises:

an upper component cladding the portion of the upper surface adjacent to the opening; and a lower component cladding the portion of the lower surface adjacent to the opening;

wherein:

the upper component comprises an upper connector;

the lower component comprises a lower connector;

at least one of the upper and the lower connector extends into the opening; and the upper and lower connectors form a connection therebetween.

10. The kickboard apparatus according to claim 9 wherein the connection is a snap-together connection.

11. The kickboard apparatus according to claim 9 wherein the blade comprises a plurality of longitudinally-extending ribs.

12. The kickboard apparatus according to claim 11 wherein the ribs are resiliently deformable.

13. The kickboard apparatus according to claim 9 wherein a first side of the blade is biased against a first side of the support structure formed to hold the blade at a fixed angle to the kickboard body.

14. The kickboard apparatus according to claim 13 wherein the blade is frictionally held in the opening by the support structure.

15. The kickboard apparatus according to claim 14 wherein at least a portion of the first side of the support structure is generally perpendicular to the lower surface of the kickboard body.

16. The kickboard apparatus according to claim 9 wherein the blade is generally perpendicular to a longitudinal centerline of the kickboard body.

17. The kickboard apparatus according to claim 15 wherein the blade is held frictionally with a force that is:

high enough to prevent the blade from moving up and down in the opening while the kickboard apparatus is being moved through the water by a swimmer; and low enough to permit a swimmer to manually move the blade up and down in the opening.

18. The kickboard apparatus according to claim 9 wherein the blade is removable from the opening.

19. The kickboard apparatus according to claim 9 wherein a latitudinal cross-section of the blade has a concave shape.

* * * * *

UNITED STATES PATENT AND TRADEMARK OFFICE

CERTIFICATE OF CORRECTION

PATENT NO. : 9,072,955 B2
APPLICATION NO. : 14/140154
DATED : July 7, 2015
INVENTOR(S) : Evan King It is certified that error appears in the above-identified patent and that said Letters Patent is hereby corrected as shown below:

On the Title page of the granted patent, directly beneath the Prior Publication Data section, insert:

-- Related U.S. Application Data

Provisional application No. 61/848,076 filed on Dec. 26, 2012. --

Signed and Sealed this
Twenty-fourth Day of November, 2015

Michelle K. Lee

Michelle K. Lee
*Director of the United States Patent and Trademark Office*